US009385456B2

(12) United States Patent
Heinrich

(10) Patent No.: US 9,385,456 B2
(45) Date of Patent: Jul. 5, 2016

(54) ELECTRICAL ASSEMBLY INCLUDING A DETACHABLE HINGE CONNECTION AND A SECURING ELEMENT

(75) Inventor: Thomas Heinrich, Ditzingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 49 days.

(21) Appl. No.: 14/004,813

(22) PCT Filed: Feb. 17, 2012

(86) PCT No.: PCT/EP2012/052797

§ 371 (c)(1),
(2), (4) Date: Nov. 19, 2013

(87) PCT Pub. No.: WO2012/123221

PCT Pub. Date: Sep. 20, 2012

(65) Prior Publication Data

US 2014/0065854 A1 Mar. 6, 2014

(30) Foreign Application Priority Data

Mar. 15, 2011 (DE) ..... 10 2011 005 544

(51) Int. Cl.

| | |
|---|---|
| ***H01R 12/71*** | (2011.01) |
| ***H01R 12/70*** | (2011.01) |
| ***H01R 13/627*** | (2006.01) |
| *H01R 12/83* | (2011.01) |
| *H01R 12/75* | (2011.01) |
| *H01R 13/50* | (2006.01) |
| *H01R 107/00* | (2006.01) |

(52) U.S. Cl.

CPC ..... *H01R 12/71* (2013.01); *H01R 12/7023* (2013.01); *H01R 13/6272* (2013.01); *H01R 12/714* (2013.01); *H01R 12/75* (2013.01); *H01R 13/501* (2013.01); *H01R 2107/00* (2013.01)

(58) Field of Classification Search

CPC ..... H01R 12/71; H01R 12/2023; H01R 13/6272; H01R 12/714; H01R 12/83; H01R 12/7005; H01R 12/7011; H01R 12/7017; H01R 12/7023

USPC ..... 439/78, 77, 660

See application file for complete search history.

(56) References Cited

U.S. PATENT DOCUMENTS 3,526,869 A 9/1970 Conrad et al.
3,701,071 A * 10/1972 Landman ..... 200/5 R (Continued)

FOREIGN PATENT DOCUMENTS

CN 1599148 A 3/2005
CN 200994011 Y 12/2007

(Continued)

OTHER PUBLICATIONS

International Search Report for PCT/EP2012/052797, issued on May 14, 2012.

*Primary Examiner* — Amy Cohen Johnson
*Assistant Examiner* — Matthew T Dzierzynski
(74) *Attorney, Agent, or Firm* — Norton Ruse Fulbright US LLP

(57) ABSTRACT

An electrical assembly is described, including a mounting board having at least one exposed contact area and a mounting board housing, a direct plug element having a housing and at least one direct contact. The direct contact establishes contact with the contact area in the assembled state, a detachable first hinge connection having a hinge member on the mounting board housing and a second hinge member on the housing of the direct plug element. A securing element secures the direct plug element on the mounting board housing.

10 Claims, 3 Drawing Sheets

(56) References Cited

U.S. PATENT DOCUMENTS

| | | | | |
|---|---|---|---|---|
| 4,093,345 | A | 6/1978 | Logan et al. | |
| 8,100,701 | B2 * | 1/2012 | Gerber et al. | 439/77 |
| 2012/0021625 | A1 * | 1/2012 | Horikawa et al. | 439/78 |

FOREIGN PATENT DOCUMENTS

| | | | |
|---|---|---|---|
| CN | 101728718 | A | 6/2010 |
| JP | S52146254 | A | 12/1977 |
| JP | S60192327 | A | 9/1985 |

* cited by examiner

ELECTRICAL ASSEMBLY INCLUDING A DETACHABLE HINGE CONNECTION AND A SECURING ELEMENT

FIELD OF THE INVENTION

The present invention relates to an improved multiple direct contacting of electrical components, such as printed circuit boards, as well as a mounting plate having improved direct contact possibilities and an improved direct plug element.

BACKGROUND INFORMATION

The use of direct plug contacts in which a direct plug element is plugged in directly on a mounting plate, e.g., a circuit board, has been increasing lately. In a large number of contact areas on the circuit board, the contact areas are situated in a row close to an edge of the circuit board, in this context. In a large number of contact areas, there comes about, for this reason, a corresponding length on the circuit board as well as complicated wiring on the circuit board, since because of this, the paths between the contact areas and components on the circuit board each have to be enlarged with the number of contact areas. A further problem area with direct contacting is that usually the direct plug elements have to be pushed onto the contact areas on the circuit board from in front. In this context, the direct contacts of the plug elements rub against the contact areas of the circuit board over the path length of the plugging process. Because of this, in response to each plugging process, the surfaces of the direct contacts and of the contact areas on the circuit board are abraded, and they clearly wear in response to a plurality of plugging processes. In this connection, it was established that in control units, for example, the plugging processes are among processes causing the severest damage on the control unit in its product life.

SUMMARY

In contrast, the electrical assembly according to the present invention has the advantage that a rubbing line length during plugging in or removing the direct plug element is clearly reduced compared to the related art. Because of that, significant signs of wear on direct contacts of the direct plug element, as well as the contact areas of the mounting board are able to be reduced. Consequently, according to the present invention, the direct plug element may be separated from the mounting board many times and plugged in again without a problem. This brings about the further advantage that thinner protective layers, which are usually made of gold, may be used on the contact surfaces at the contact areas or the direct contacts. A significant cost saving is thereby made possible. According to the present invention, this is achieved in that the sliding motion carried out in the related art is replaced by a tilting process. For this purpose the electrical assembly includes a mounting board, a circuit board, for example, having exposed contact areas and a mounting board housing, as well as a direct plug element having a housing and direct contacts which contact the contact areas of the mounting board in the mounted state. Moreover, a first detachable hinge connection is provided between a first hinge member on the mounting board housing of the mounting board, and a second hinge member on the housing of the direct plug element. A securing element secures the direct plug element on the mounting board housing of the mounting board, in order to avoid the undesired detaching of the direct plug connection, for instance, caused by vibrating processes in the vehicle.

The first detachable hinge connection preferably includes a first hook-shaped hinge member and a second hook-shaped hinge member. The second hinge member is developed in complementary fashion to the first hinge member. One thereby obtains a hinge connection that is able to be connected simply and rapidly, and in a detachable manner.

Further preferred, all direct contacts on the direct plug element are identical. This enables a particularly simple design of the direct plug element, whereby large cost savings may be attained by a large number of identical parts.

It is also preferred that the exposed contact areas on the mounting board are arranged in multiple rows. The length, in particular, of the arrangement of contact areas on the mounting board may thereby be reduced.

The securing element preferably includes a first hook part, which is situated on the housing of the direct plug element via a second hinge connection. Furthermore, on the housing of the mounting board, a second hook part is provided, that is formed in a complementary manner to the first hook part. The second hinge connection of the securing element, by which the first hook part is fastened to the housing of the direct plug element, may particularly be a film hinge or a mechanical hinge. A film hinge made of plastic is especially preferred in this context, the film hinge providing an extremely thin connection of two parts. The film hinge in this instance is preferably made of a plastic material.

Particularly preferred, the second hinge connection runs over the entire width of the housing of the direct plug element.

Further preferred, the direct contacts, in the mounted state, are provided at an angle to a plane of the mounting board in which the contact areas are situated on the mounting board. The angle is preferably less than, or equal to 60°, further preferred ca. 45°, and for a very flat direct plug element, less than, or equal to 30°.

Further preferred, the direct contacts have an arched end region, which comes into contact with the contact areas on the mounting board, in the mounted state. On the arched end regions of the direct contacts, preferably also point contacts are provided for a point-shaped contact. The point contacts may, for instance, be punched up from the arched end regions.

The present invention further relates to a mounting board having a first hinge member on a housing. The first hinge member is equipped to make possible a detachable hinge connection with a second hinge member on the direct plug element.

Furthermore, the present invention relates to a direct plug element having a housing and direct contacts, as well as a second hinge member on the housing. The second hinge member is equipped to provide a detachable hinge connection with the first hinge member on a mounting board housing.

The present invention is preferably used in a control unit for vehicles.

DETAILED DESCRIPTION

With reference to FIGS. 1 to 5, an electrical assembly 1 according to a preferred exemplary embodiment of the present invention is described in detail below.

Figure 1:
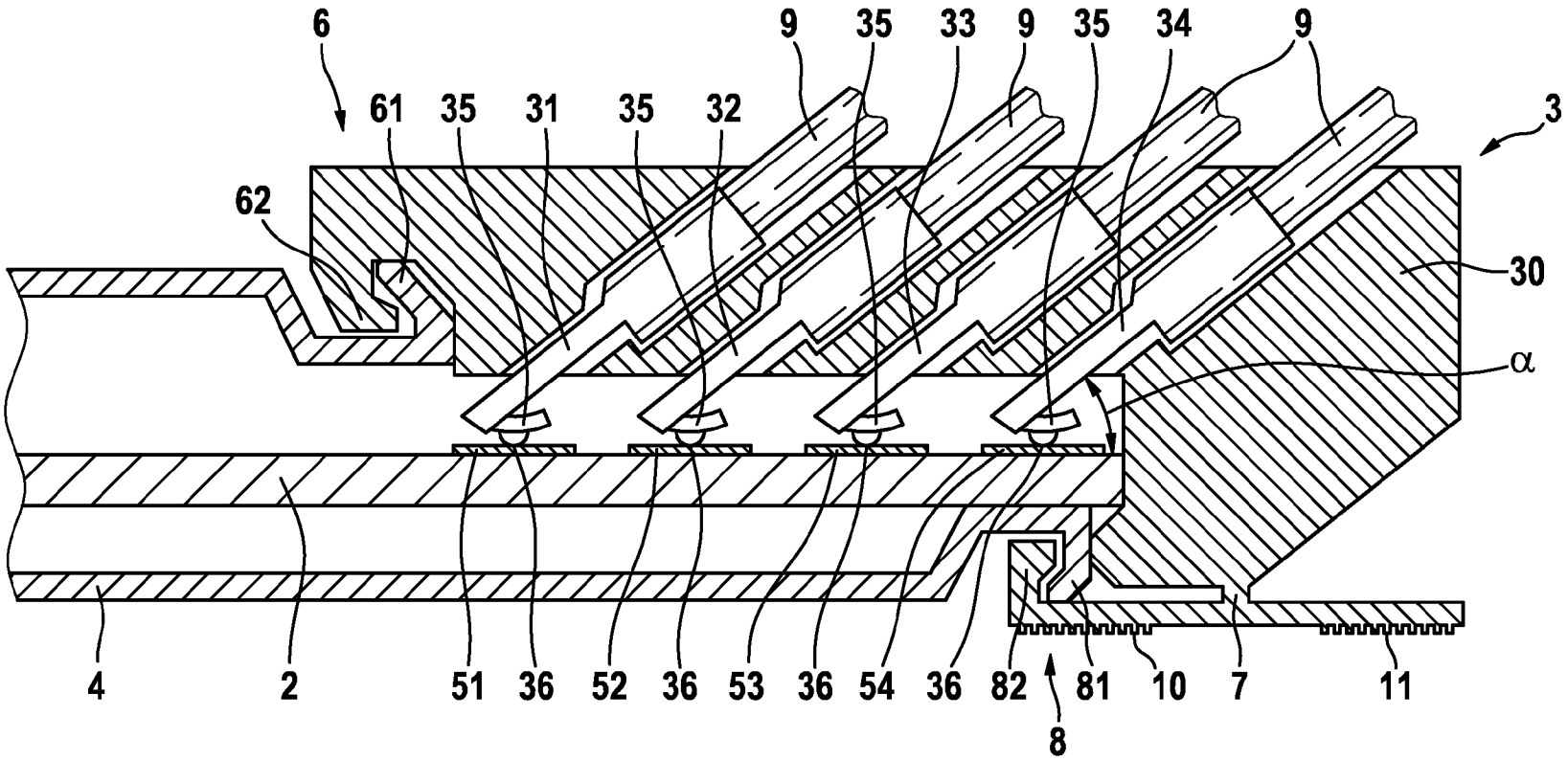
FIG. 1 shows a schematic sectional view of an electrical assembly according to an exemplary embodiment of the invention in the mounted state.

As may be seen in FIG. 1, electrical assembly 1 includes a mounting board 2 developed as a circuit board. Mounting board 2 includes a mounting board housing 4 as well as a plurality of contact areas 51, 52, 53, 54, which are developed as contact pads. The plurality of contact areas 51, 52, 53, 54 is arranged in rows (in FIG. 1 perpendicular to the sectional plane of FIG. 1), so that several rows of contact areas are provided. In this context, all contact areas are directed exposed to the outside, i.e. not surrounded by a housing area.

Electrical assembly 1 also includes a direct plug element 3, which includes a housing 30 and a plurality of direct contacts 31, 32, 33, 34. Direct contacts 31, 32, 33, 34, in the mounted state shown in this context in FIG. 1, each come into contact with contact areas 51, 52, 53, 54. For this, the direct contacts are situated at an angle $\alpha$ of ca. 45° to a plane of contact areas.

Between mounting board housing 4 of mounting board 2 and direct plug element 3, a first hinge connection 6 is developed. First hinge connection 6 includes a first hinge member 61 on mounting board housing 4 and a second hinge member 62 on housing 30 of direct plug element 3. First hinge member 61 is developed as a first hook and second hinge member 62 is a second counter-hook developed complementary to the first hook.

Furthermore, electrical assembly 1 includes a securing device 8, which secures direct plug element 3 on mounting board housing 4. Securing device 8 includes a first hook part 81, which is formed on mounting board housing 4 and a second hook part 82, which is formed on housing 30 of direct plug element 3. The two hook parts 81, 82, in turn, are developed complementary to each other. Second hook part 82 is connected via a second hinge connection 7 to housing 30 of the direct plug element. Second hinge connection 7 is a film hinge made of a plastic, second hook part 82 being situated on housing 30 in a rocker-type manner. At the side of second hook part 82 facing away from housing 30, a first pressure surface 10 for closing the securing device is provided, and a second pressure surface 11 for opening securing device 8 is provided.

As may further be seen in FIG. 1, direct contacts 31, 32, 33, 34 each have an arched end region 35, on whose side directed to mounting board 2 in each case a point contact 36 is situated. Direct contacts 31, 32, 33, 34 are, as may be seen in FIG. 1, all identical, and are connected via one cable 9 each. The direct contacts, in this instance, may be connected to the cables using known methods, such as crimping.

FIGS. 2 through 5 show an assembly process in detail for carrying out the direct plug connection.

Figure 2:
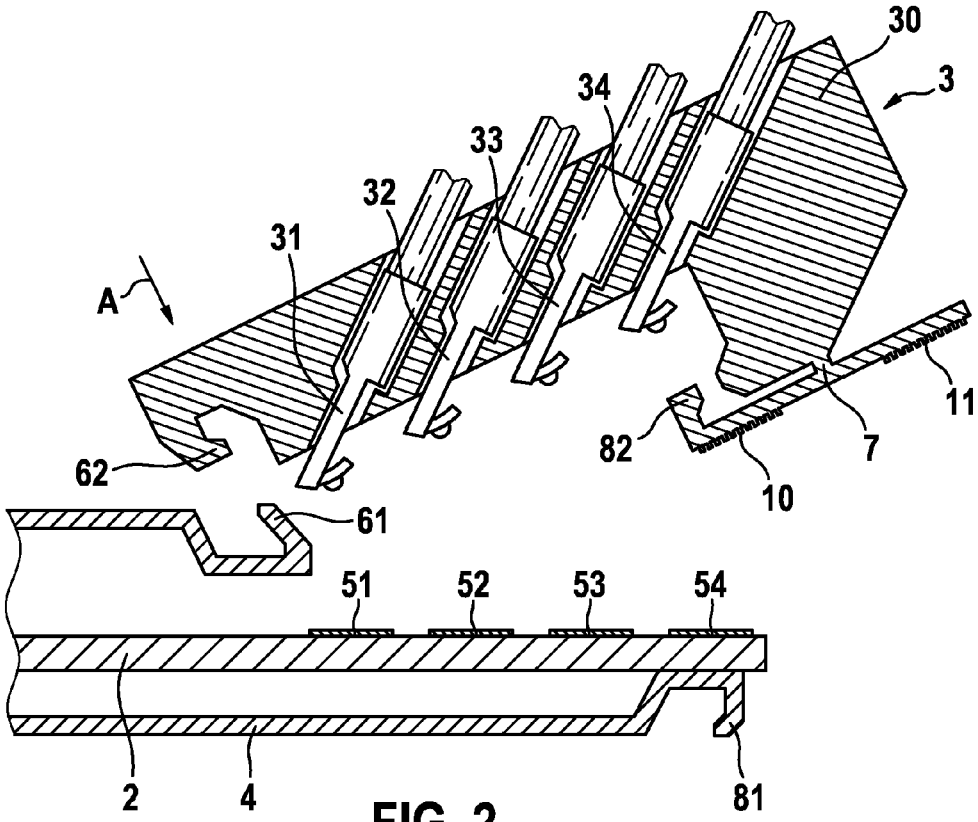
FIGS. 2 through 5 show schematic sectional views of an assembly process of a direct plug element on a mounting board according to the exemplary embodiment according to the present invention.
Figure 3:
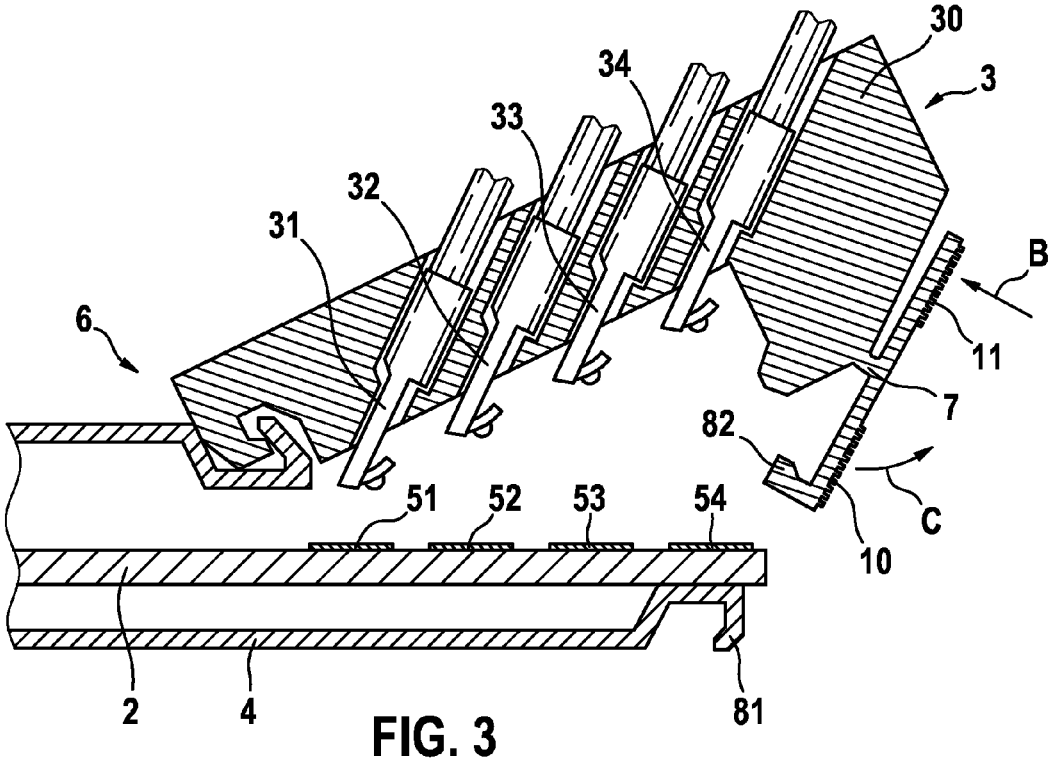

FIG. 2 shows the separate state of mounting board 2 and direct plug element 3. Direct plug element 3 is moved in the direction of arrow A towards mounting board 2, in order to produce the detachable first hinge connection 6. In this process, as shown in the assembly position in FIG. 3, second hinge member 62 is hooked together with first hinge member 61. Then, by pressing on second pressure surface 11, second hook part 82 and second hinge connection 7 are pivoted in the direction of arrow C, in order to enable the setting of the direct contacts onto the contact areas.

Figure 4:
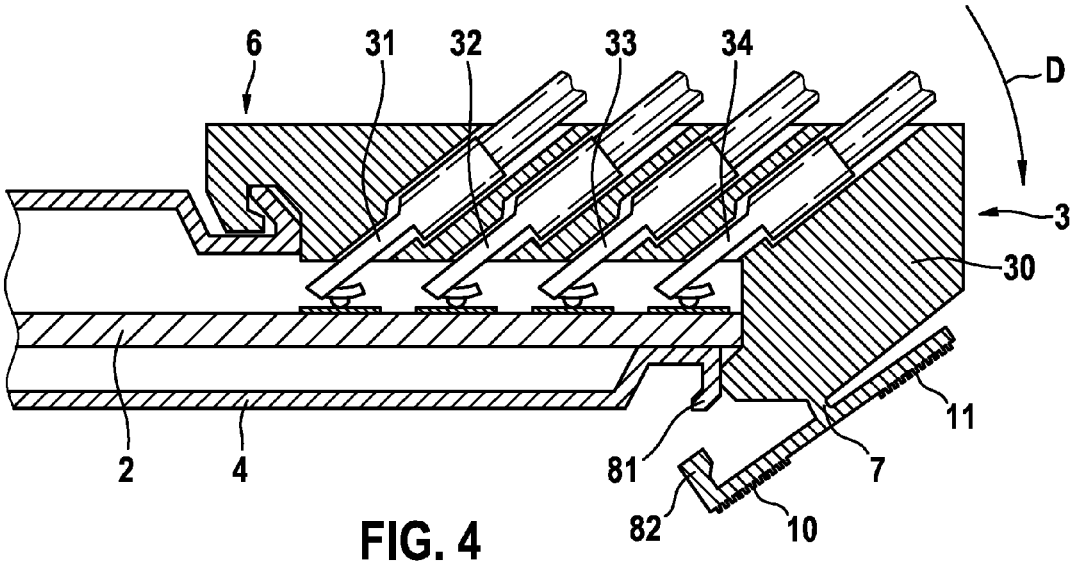
Figure 5:
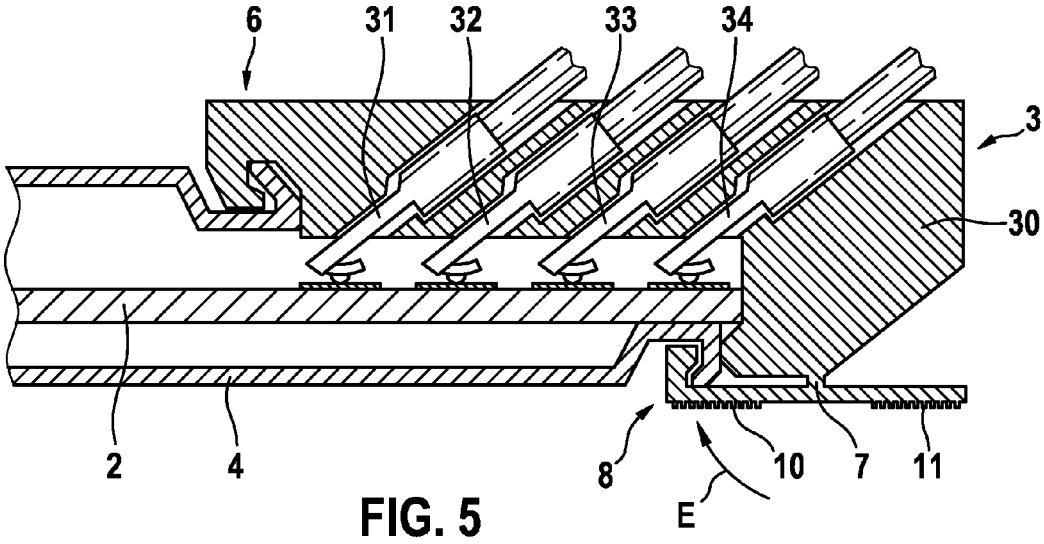

In the next assembly step shown in FIG. 4, the direct plug element is pivoted in the direction of arrow D about first hinge connection 6, whereby direct contacts 31, 32, 33, 34 come into contact with contact areas 51, 52, 53, 54. Thereafter, as indicated in FIG. 5 by arrow E, second hook part 82 is pivoted about second hinge connection 7, so that second hook part 82 engages first hook part 81, and securing device 8 secures direct plug element 3 to mounting board housing 4 of mounting board 2. In this context, pressure is exerted on first pressure surface 10 on second hook part 82. Second hook part 82 demonstrates a certain elasticity in this context, so that it snaps without great expenditure of force behind first hook part 81 and secures direct plug element 3 to mounting board housing 4.

In order to detach again direct contacting between mounting board 2 and direct plug element 3, pressure is first exerted on second pressure surface 11, in order to open securing device 8. After that, direct plug element 3 is pivoted upwards again about first hinge connection 6, and then direct plug element 3 is separated from mounting board 2 by unhooking second hinge member 62 from first hinge member 61.

Consequently, according to the present invention, a direct plug connection is no longer able to be produced by a sliding motion but, according to the present invention, the direct plug connection is obtained by hooking direct plug element 3 into mounting board housing 4 of mounting board 2, and pivoting about detachable hinge connection 6 thus formed. Because of this procedure, one is able to provide, in particular, only a thin protective layer on contact areas 51, 52, 53, 54 or rather point contacts 36. In this context, a large number of contact areas may be provided in a plurality of rows. The positioning of the contact areas and the direct contacts in a plurality of rows further has the advantage that thereby the length of direct plug element 3 is increased, whereby one obtains a favorable torque because of the resulting lever forces. The direct plug connection may thereby be implemented using only slight force expenditure.

It should further be noted that, for secure mounting, one or more stops may be provided, which limit the pivoting motion of direct plug element 3 about first hinge connection 6. It should further be noted that first and second hook parts 81, 82 of securing device 8 may be developed in such a way that, upon the real snapping in of the two hook parts into each other, a corresponding noise is created, which provides an acoustical signal to the assembler that a correct direct plug connection has been established.

In order to provide as great a stability as possible of first hinge connection 6 and securing device 8, first hinge member 61 and second hinge member 62 as well as first and second hook parts 81, 82 are provided in channel fashion over the entire width of mounting board housing 4 and of housing 30 of direct plug element 3.

What is claimed is:

1. An electrical assembly, comprising:

a mounting board having at least one exposed contact area and a mounting board housing;

a direct plug element having a housing and at least one direct contact, the direct contact contacting a contact area in an assembled state;

a detachable first hinge connection having a hinge member on the mounting board housing and a second hinge member on the housing of the direct plug element; and a securing device securing the direct plug element on the mounting board housing, wherein:

the securing device includes a first hook part situated on the mounting board housing, and a second hook part situated on the housing of the direct plug element, the second hook part is situated on the housing of the direct plug element via a second hinge connection, the second hook part is part of a rocker element that includes first and second pressure surfaces, the rocker element pivots via the second hinge connection along a first direction when the first pressure surface is pressed in order to engage the second hook part with the first hook part, and the rocker element pivots via the second hinge connection along a second direction when the second pressure surface is pressed in order to disengage the second hook part from the first hook part.

2. The assembly as recited in claim 1, wherein the first hinge member and the second hinge member of the first hinge connection are each hook-shaped.

3. The assembly as recited in claim 1, wherein the at least one direct contact includes direct contacts that are all identical.

4. The assembly as recited in claim 1, wherein the at least one exposed contact area includes exposed contact areas and the at least one direct contact includes direct contacts, the exposed contact areas and the direct contacts are arranged in a plurality of rows.

5. The assembly as recited in claim 1, wherein the second hinge connection is one of a film hinge and a mechanical hinge.

6. The assembly as recited in claim 1, wherein the at least one direct contact includes direct contacts that in a mounted state are situated at an angle to a plane of the mounting board.

7. The assembly as recited in claim 1, wherein the at least one direct contact includes direct contacts that have an arched end region.

8. The assembly as recited in claim 7, wherein at the arched end region a point contact is provided.

9. A mounting board, comprising:

at least one exposed contact area;

a mounting board housing;

a first hinge member situated on the mounting board housing and equipped to provide a detachable hinge connection via a second hinge member; and a first hook part situated on the mounting board housing and able to be brought to engagement with a second hook part of a securing device, the second hook part being situated on a housing of a direct plug element via a second hinge connection, wherein:

the second hook part is part of a rocker element that includes first and second pressure surfaces, the rocker element pivots via the second hinge connection along a first direction when the first pressure surface is pressed in order to engage the second hook part with the first hook part, and the rocker element pivots via the second hinge connection along a second direction when the second pressure surface is pressed in order to disengage the second hook part from the first hook part.

10. A direct plug element, comprising:

a housing;

at least one direct contact;

a second hinge member situated on the housing and developed to provide a detachable hinge connection using first hinge member;

a second hook part situated on the housing and able to be brought to engagement with a first hook part of a securing device; and a second hook part situated on the housing via a second hinge connection, wherein:

the second hook part is part of a rocker element that includes first and second pressure surfaces, the rocker element pivots via the second hinge connection along a first direction when the first pressure surface is pressed in order to engage the second hook part with the first hook part, and the rocker element pivots via the second hinge connection along a second direction when the second pressure surface is pressed in order to disengage the second hook part from the first hook part.

* * * * *